US009360245B2

(12) United States Patent
Lee et al.

(10) Patent No.: US 9,360,245 B2
(45) Date of Patent: Jun. 7, 2016

(54) REFRIGERATOR

(75) Inventors: Youn Seok Lee, Seoul (KR); Jang Seok Lee, Seoul (KR); So Hee Park, Seoul (KR); Su Nam Chae, Seoul (KR); Min Kyu Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 283 days.

(21) Appl. No.: 13/386,320

(22) PCT Filed: Jul. 23, 2010

(86) PCT No.: PCT/KR2010/004866

§ 371 (c)(1),
(2), (4) Date: Jan. 20, 2012

(87) PCT Pub. No.: WO2011/016635

PCT Pub. Date: Feb. 10, 2011

(65) Prior Publication Data

US 2012/0131942 A1 May 31, 2012

(30) Foreign Application Priority Data

Aug. 5, 2009 (KR) ..... 10-2009-0071908

(51) Int. Cl.

| | |
|---|---|
| ***F25D 23/00*** | (2006.01) |
| ***F25D 17/06*** | (2006.01) |
| ***F25D 21/14*** | (2006.01) |

(52) U.S. Cl.

CPC ..... *F25D 23/006* (2013.01); *F25D 17/065* (2013.01); *F25D 21/14* (2013.01); *Y10T 29/49359* (2015.01)

(58) Field of Classification Search

CPC .... F25B 23/003; F25B 23/006; F25B 23/069; F25B 2317/06; F25B 2323/0021

See application file for complete search history.

(56) References Cited

U.S. PATENT DOCUMENTS

| | | | | |
|---|---|---|---|---|
| 3,785,171 | A * | 1/1974 | Beranek et al. | 62/490 |
| 4,776,182 | A * | 10/1988 | Gidseg | 62/448 |
| 6,257,846 | B1 * | 7/2001 | Muramatsu et al. | 417/410.3 |
| 6,866,090 | B2 * | 3/2005 | Takamatsu et al. | 165/41 |
| 2007/0044491 | A1 * | 3/2007 | Prince et al. | 62/239 |
| 2009/0173483 | A1 * | 7/2009 | Beamer et al. | 165/173 |

FOREIGN PATENT DOCUMENTS

| | | | |
|---|---|---|---|
| JP | 2007-064497 | A | 3/2007 |
| WO | WO 99/58914 | A1 | 11/1999 |

* cited by examiner

*Primary Examiner* — Judy Swann
*Assistant Examiner* — Zachary R Anderegg
(74) *Attorney, Agent, or Firm* — Birch, Stewart, Kolasch & Birch, LLP

(57) ABSTRACT

A refrigerator is disclosed. The refrigerator includes a cabinet comprising a storage chamber, a cold air generation chamber provided above the storage chamber, an evaporator provided in the cold air generation chamber, and a refrigerant tube configured to pass through a predetermined wall of the cold air generation chamber, not passing the storage chamber, to be connected with the evaporator. An object of the present disclosure is to provide a refrigerator which has an efficient installation structure of a refrigerant tube connected with an evaporator provided in a cold air generation chamber provided above a storage chamber to enlarge storage space of the storage chamber.

11 Claims, 6 Drawing Sheets

REFRIGERATOR

TECHNICAL FIELD

The present disclosure relates to a refrigerator, more particularly to, a refrigerator having a cold air generation chamber having an evaporator installed therein which is provided above a storage chamber, with a refrigerant tube connected to the evaporator which is arranged in the cold air generation chamber, not passing the storage chamber, only to simplify an inner structure thereof.

BACKGROUND ART

Generally, refrigerators use a four step cooling cycle configured of compression, expansion and evaporation of refrigerant to preserve food stuffs fresh and frozen. Such a refrigerator includes a cabinet including a storage chamber provided therein, a door provided in the cabinet to open and close the storage chamber, a cold air generation chamber having an evaporator therein to generate cold air and a mechanism chamber configured to accommodate parts such as a compressor and a condenser and the like.

According to the configuration of the conventional refrigerator, the cold air generation chamber is provided in the storage chamber, specifically, in a rear portion of a refrigerating or freezing compartment composing the storage chamber. The storage chamber and the cold air generation chamber are partitioned off by a predetermined partition wall.

DISCLOSURE OF INVENTION

Technical Problem

The mechanism chamber is typically provided in a lower rear portion of the storage chamber.

Under this conventional configuration, the storage chamber and the cold air generation chamber are arranged in a forward and backward direction. Because of that, the cabinet happens to be thicker disadvantageously.

Moreover, the mechanism chamber is installed in a lower rear surface of the cabinet. Because of that, a lower space of the storage chamber happens to be reduced as much as the space of the mechanism chamber.

There have been increasing demands for a refrigerator which can secure larger storage space by changing locations of the mechanism and cold air generation chambers, with efficient assembly of inner configuration elements.

Solution to Problem

Accordingly, the present disclosure is directed to a refrigerator which has an efficient installation structure of a refrigerant tube connected with an evaporator provided in a cold air generation chamber provided above a storage chamber to enlarge storage space of the storage chamber.

Additional advantages, objects, and features of the disclosure will be set forth in part in the description which follows and in part will become apparent to those having ordinary skill in the art upon examination of the following or may be learned from practice of the invention. The objectives and other advantages of the disclosure may be realized and attained by the structure particularly pointed out in the written description and claims hereof as well as the appended drawings.

To achieve these objects and other advantages and in accordance with the purpose of the invention, as embodied and broadly described herein, a refrigerator includes a cabinet comprising a storage chamber; a cold air generation chamber provided above the storage chamber; an evaporator provided in the cold air generation chamber; and a refrigerant tube configured to pass through a predetermined wall of the cold air generation chamber, not passing the storage chamber, to be connected with the evaporator.

The refrigerant tube may include a capillary tube configured to reduce a pressure of refrigerant drawn into the evaporator so as to expand a volume of the refrigerant; and a guide tube configured to guide the refrigerant exhausted from the evaporator toward a compressor provided outside the cold air generation chamber.

The refrigerator may further include an installation part provided in the predetermined wall of the cold air generation chamber, wherein the refrigerant tube is configured to pass through the installation part.

The refrigerator may further include a rim part configured to surround the installation part, wherein the rim part is formed thicker than the installation part to reinforce rigidity of a rim of the installation part.

The refrigerant tub may include a first refrigerant tube connected with the evaporator; and a second refrigerant tube installed through the installation part.

The first refrigerant tube and the second refrigerant tube may be welded to be connected with each other.

The second refrigerant tube may be able to be bent to allow the connection with the first refrigerant tube implemented efficiently.

The evaporator may be located in a predetermined portion in rear of the installation part and the first refrigerant tube may be located in front of a front surface of the evaporator to be connected with the second refrigerant tube having passed the installation part provided in front of the evaporator, in a line.

The refrigerator may further include a defrosted-water tray provided below the evaporator and the first and second refrigerant tubes to receive defrosted-water generated in the evaporator and the first and second refrigerant tubes therein.

In another aspect of the present invention, a manufacturing method of a refrigerant comprising a cold air generation chamber provided above a storage chamber, with an evaporator installed therein, the manufacturing method includes (A) step of installing a first refrigerant tube through a predetermined wall of the cold air generation chamber; (B) step of installing the evaporator comprising a second refrigerant tube corresponding to the first refrigerant tube in the cold air generation chamber; and (C) step of connecting the first refrigerant tube and the second refrigerant tube with each other.

The step of (C) may include (C-1) step of adjusting locations of ends of the first and second refrigerant tubes to be identical to each other, in case the location of the ends are not identical to each other; (C-2) step of welding the ends of the first and second refrigerant tubes to be connected, after locating the ends of the first and second refrigerant tubes to be identical to each other.

The step of (C-1) may include a step of changing the shape of the bent first refrigerant tube to be in a line with the second refrigerant tube.

Advantageous Effects of Invention

The refrigerator according to the present invention, a mechanism chamber and a cold air generation chamber are located above a cabinet. As a result, more enlarged inner space of a storage chamber may be secured in comparison to inner space of the conventional storage chamber and enlarged storage space for storage objects may be secured accordingly.

Furthermore, installation of a refrigerant tube connected with an evaporator provided in the cold air generation chamber may be implemented more smoothly and efficiently.

BRIEF DESCRIPTION OF DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

As follows, a refrigerator according to an exemplary embodiment of the present disclosure will be described in reference to the accompanying drawings.

It is to be understood that both the foregoing general description and the following detailed description of the present disclosure are exemplary and explanatory and are intended to provide further explanation of the disclosure as claimed.

Figure 1:
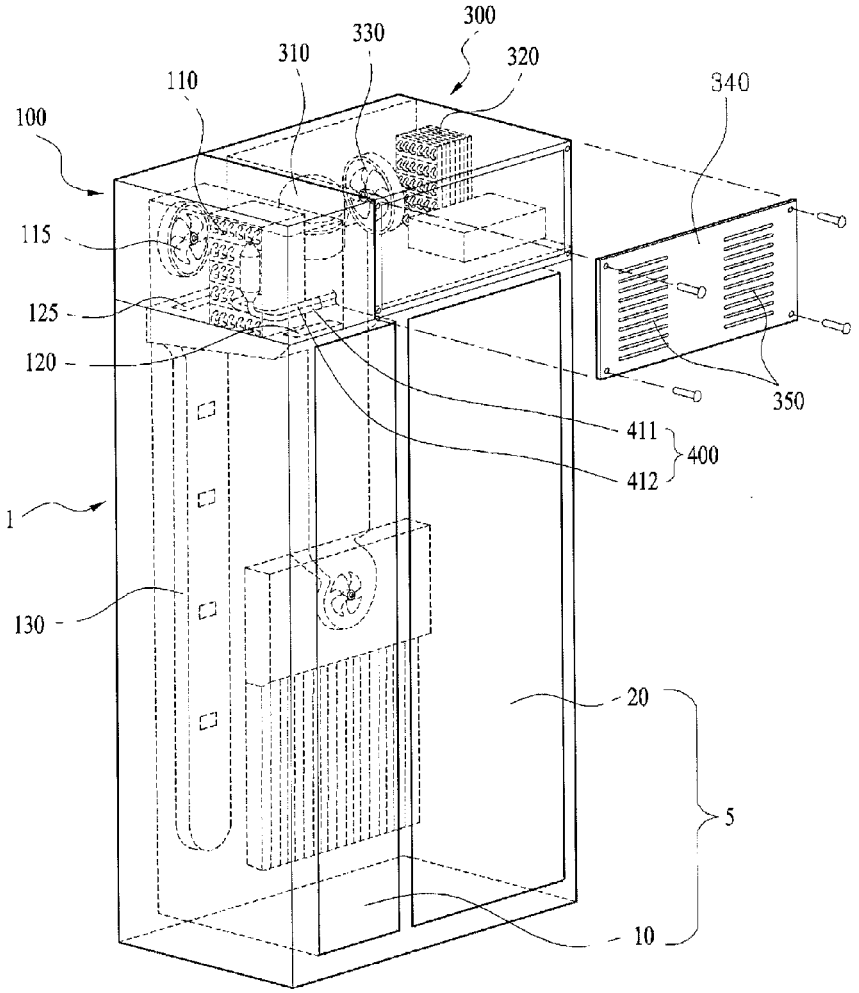
FIG. 1 is a perspective view illustrating a refrigerator according to an exemplary embodiment of the present invention.

In reference to FIG. 1, the refrigerator according to the exemplary embodiment of the present disclosure includes a cabinet 1 configured to define an exterior appearance thereof and a predetermined storage chamber 5 provided in the cabinet. Here, the storage chamber 5 is configured of freezing and refrigerating compartments 10 and 20.

The freezing and refrigerating compartments 10 and 20 are arranged in parallel. A cold air generation chamber is provide in each of the freezing and refrigerating compartments 10 and 20 to preserve storing objects frozen or refrigerated based on an independent cooling type.

A cold air generation chamber 100 may be provided on an upper surface of the cabinet 1, correspondingly beyond the freezing compartment 10. A mechanism chamber 300 is installed next to the cold air generation chamber 100 and the mechanism chamber 300 receives a compressor 310, a condenser 320 and the like therein.

The cold air generation chamber 100 includes an evaporator 110 and a cold air fan 115. The cold air fan 115 for the freezing compartment draws air inside the freezing compartment 10 toward the evaporator 110 for the freezing compartment 110 and it exhausts heat-exchanged air inside the evaporator 110 for the freezing compartment toward the freezing compartment 10.

Here, the cold air fan 115 and the evaporator 110 may be arranged horizontally. It is preferable that the evaporator may be arranged in front of the cold air fan 115.

The cold air generation chamber 100 may be covered by predetermined heat-insulating material to be heat-insulated from the outside.

Here, the appearance of the evaporator 110 for the freezing compartment may be approximately rectangular block-shaped to correspond with inner space of the cold air generation chamber 100 for the freezing compartment.

A cold air inlet 120 and a cold air outlet 125 are formed in a lower surface of the cold air generation chamber 100. The cold air inlet 120 enables the cold air generation chamber 100 to communicate with the freezing compartment 10 and it guides the air of the freezing compartment 120 into the cold air generation chamber 100. The cold air outlet 125 is adjacent to the cold air fan 115 to guide the air exhausted from the cold air generation chamber toward the freezing compartment 10.

The evaporator 110 may be installed between the cold air outlet 125 and the cold air inlet 120.

The cold air outlet 125 is connected with a predetermined guide duct 130 to distribute the cold air exhausted from the cold air outlet 125 into the freezing compartment 10 uniformly.

This configuration makes the cold air circulated via a circulation process configured of the freezing compartment 10, the cold air inlet 120, the evaporator 110 for the freezing compartment, the cold air fan 115 for the freezing compartment, the cold air outlet 125, the guide duct 130 and the freezing compartment sequentially.

The cold air generation chamber 300 for the refrigerating compartment 20 configured to supply cold air to the refrigerating compartment 20 is installed adjacent to the refrigerating compartment 20, specifically, in the cabinet 10, not on the cabinet like the cold air generation chamber 100 for the freezing compartment.

This embodiment presents that the cold air fan 115 is adjacent to the cold air outlet 110. Alternatively, the cold air fan 115 is installed adjacent to the cold air inlet 120 to blow the cold air sucked from the freezing chamber 10 toward the evaporator 110.

Although not shown in FIG. 1, the relation between the freezing compartment 10 and the cold air generation chamber 100 may be applicable to the relation between the refrigerating compartment 20 and a cold air generation chamber for the refrigerating compartment configured to supply cold air to the refrigerating compartment.

In the meanwhile, the mechanism chamber 300 is provided in a predetermined portion adjacent to the cold air generation chamber 100 as mentioned above. there may be provided in the mechanism chamber 300 a condenser 320 configured to condense refrigerant, a condenser fan 30 provided adjacent to the condenser 320 and a compressor 310 configured to compress the refrigerant.

Here, it is preferable that the cold air generation chamber 200 may be located in parallel to the mechanism chamber 300.

The compressor 310, the condenser fan 330 and the condenser 320 may be arranged in a line and the arrangement direction may be in a rightward and leftward direction with respect to a top surface of the refrigerator.

A cover member 340 is provided in a front surface of the mechanism chamber 300 and the cover member 340 covers the mechanism chamber 300 not to be seen from the outside. A predetermined number of communication holes 350 may be provided in the cover member 340 to communicate an inside with an outside of the mechanism chamber 300, such that air may be supplied to cool the condenser 320.

Here, the height of the mechanism chamber 300 may be identical to the height of the cold air generation chamber 100 for the freezing compartment 100.

A capillary tube 411 is provided between the evaporator 110 and the condenser 320 to reduce the pressure of refrigerant to expand the refrigerant. A guide tube 412 is provided between the evaporator 110 and the compressor 310 to guide the refrigerant changed into gas in the evaporator 110 toward the compressor 310. The capillary tube 411 and the guide tube 412 will be referenced to as refrigerant tube 400 hereinafter.

Figure 2:
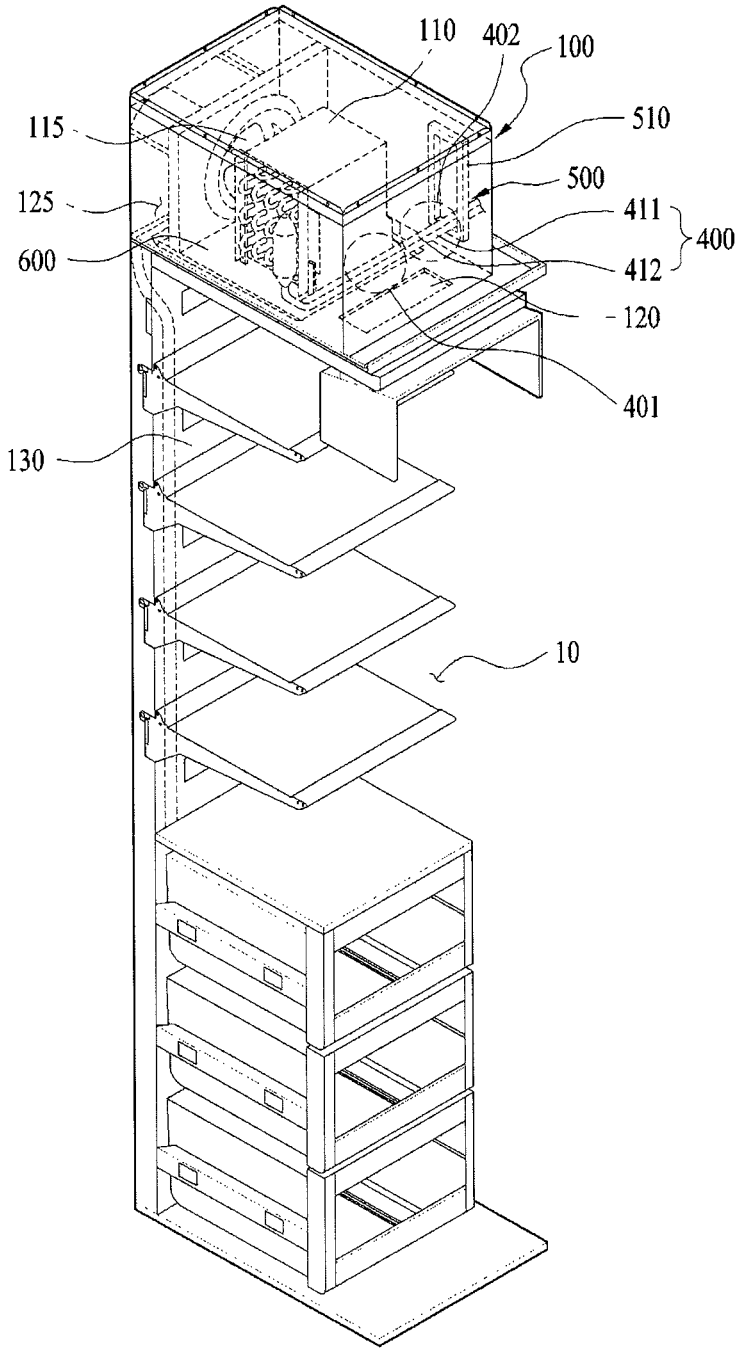
FIG. 2 is a perspective view illustrating an inner structure of the refrigerator.

As shown in FIG. 2, the evaporator 110 is installed in the cold air generation chamber 100 and an installation part 500 configured to pass the refrigerant tube 400 there through may be provided in a predetermined wall of the cold air generation chamber 100.

The location of the installation part 500 may be arranged forwarder than a front surface of the evaporator 110, because the location of the refrigerant tube 400 connected with the evaporator 110 is arranged forwarder than the front surface of the evaporator 110.

The location of the refrigerant tube 400 could be variable depending on cases and the location of the installation part 500 may be variable according to the location of the refrigerant tube 400.

A rim part 510 formed relatively thick may be provided around the installation part 500 to reinforce rigidity of the installation part 500.

The refrigerant tube 400 may be arranged in a line within the cold air generation chamber 100 to simplify the structure.

Here, the refrigerant tube 400 includes a first refrigerant tube 401 connected with the evaporator 110 and a second refrigerant tube configured to pass through the installation part 500. The first and second refrigerant tubes 401 and 402 may be connected by welding.

The refrigerant tube 400 may be directly inserted in the cold air generation chamber 100, not passing through the freezing compartment 10. Because of that, an auxiliary defrosted-water tray or frost-preventing device only for the refrigerant tube 400 may not be provided.

That is, a defrosted-water tray 600 is installed below the evaporator 110 to collect defrosted-water during a defrosting process. Here, the refrigerant tube 400 passes on the defrosted-water tray 600 and the defrosted-water on a surface of the refrigerant tube 400 together with defrosted-water on the evaporator 110 may be simultaneously collected in the defrosted-water tray 600.

Figure 3:
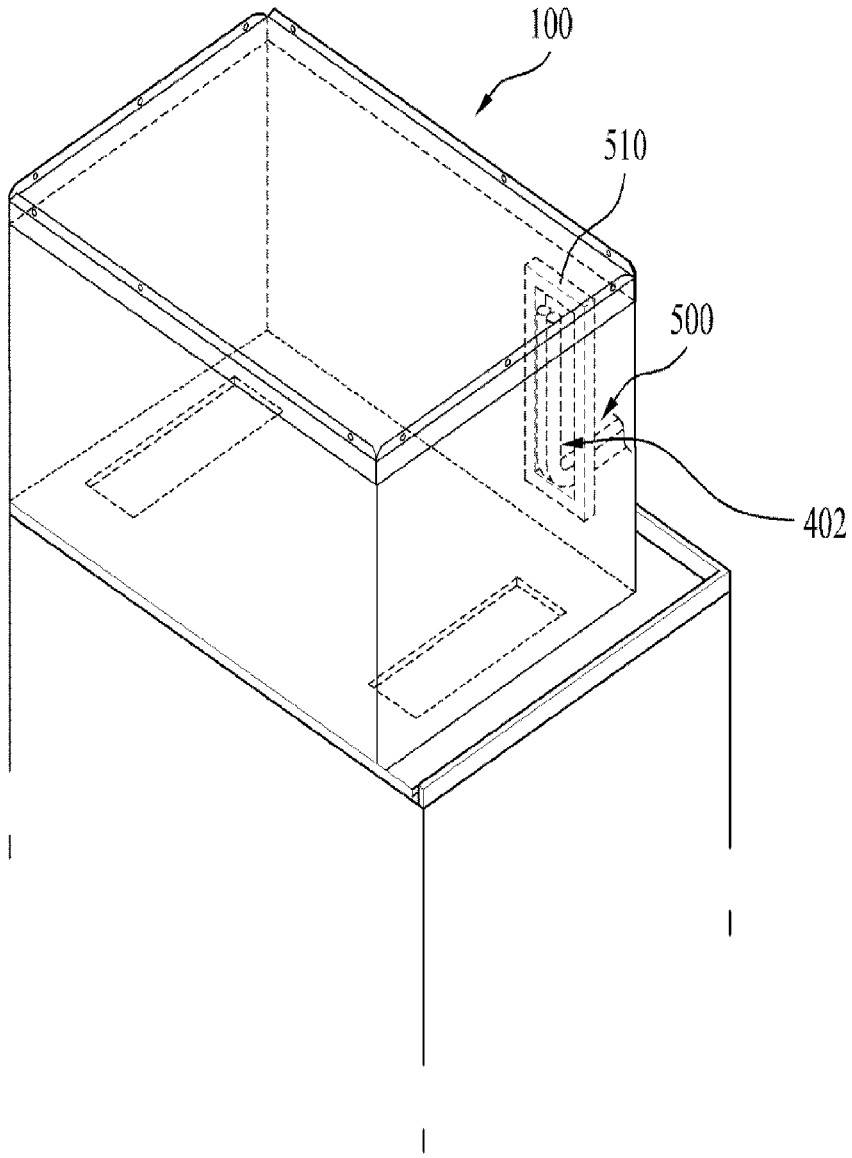
FIG. 3 is a perspective view illustrating an evaporator before installed in the refrigerator.

FIG. 3 illustrates the cold air generation chamber 100 before the evaporator 110 is installed in the cold air generation chamber 100.

Here, the second refrigerant tube 402 is installed in the installation part 500 provided in the cold air generation chamber 100. The second refrigerant tube 402 may be bent upwardly to prevent a worker's damage and to improve working efficiency.

That is, the second refrigerant tube 402 is bent for an end thereof to be adjacent to the wall of the cold air generation chamber 100 where the installation part 500 is provided. As a result, the second refrigerant tube 402 may be in contact with the evaporator to enable the working of installing the evaporator 110 implemented more efficiently.

Figure 4:
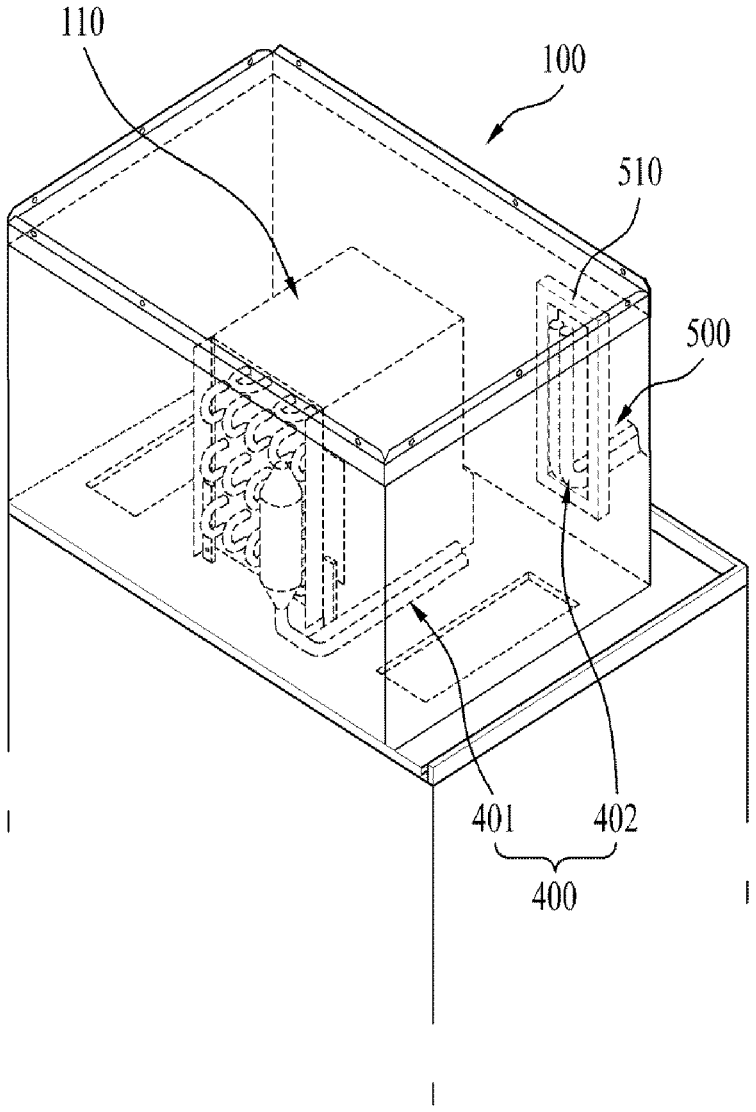
FIG. 4 is a perspective view illustrating a first refrigerant tube and a second refrigerant tube of the evaporator before they are connected with each other.

As shown in FIG. 4, the evaporator 110 is installed and fixed in the cold air generation chamber 100 in the state of the second refrigerant tube 402 being bent.

At this time, if an end of the first refrigerant tube 401 connected with the evaporator 110 is located forwarder than the evaporator 110, the installation part 500 and the rim part 510 may be located forwarder than the front surface of the evaporator 110.

If the end of the first refrigerant tube 401 is located in rear of the evaporator 110, the installation part 500 and the rim part 510 may be in a predetermined portion of the cold air generation chamber 100 which is in rear of the evaporator.

This is because the end of the second refrigerant tube 402 having passed the installation part 500 has to be connected with the end of the first refrigerant tube 401 more smoothly and efficiently.

Figure 5:
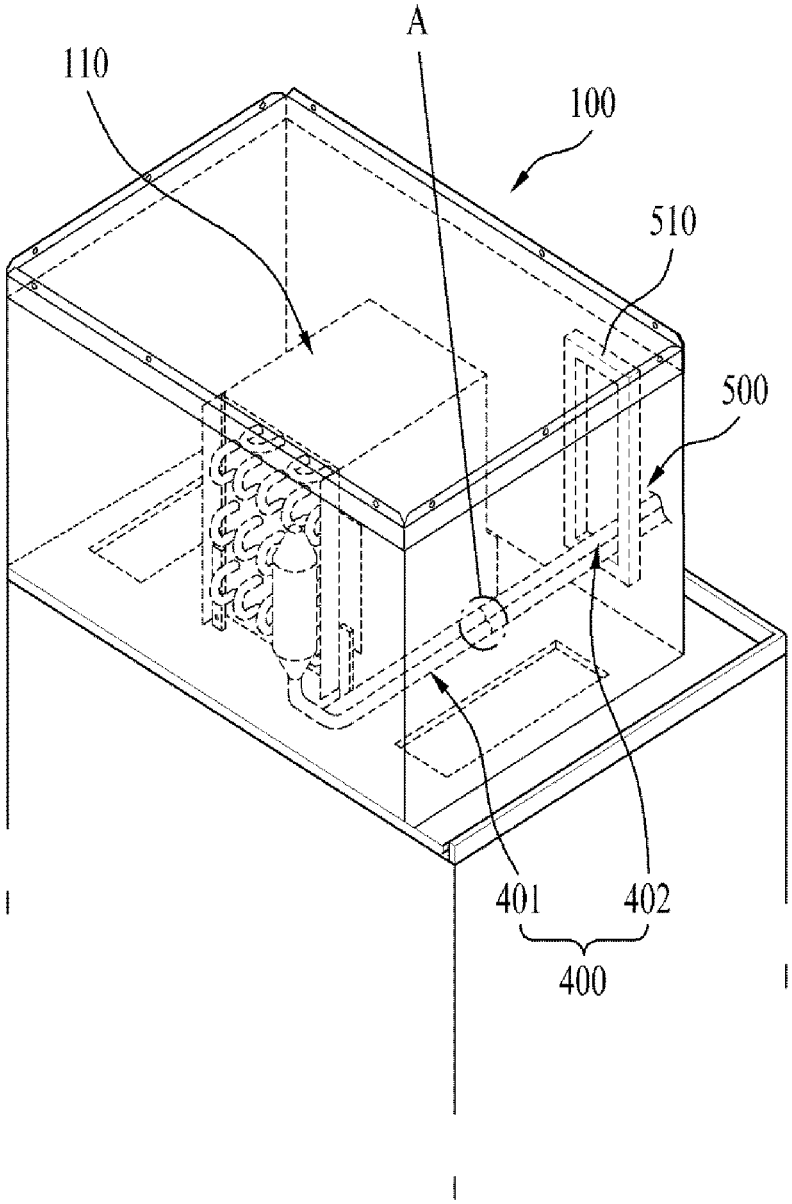
FIG. 5 is a perspective view illustrating the first and second refrigerant tubes of the evaporator after they are connected with each other.

As shown in FIG. 5, in the state of the evaporator 110 being adjacent to the bent second refrigerant tube 402, the second refrigerant tube 402 is unfold to make the end of the second refrigerant tube 402 located corresponding to the end of the first refrigerant tube 401.

After that, the end of the first refrigerant tube 401 may be in contact with the end of the second refrigerant tube 402 and the contact portion (A) is welded to connect the first refrigerant tube 401 and the second refrigerant tube 402 with each other.

As mentioned above, the first refrigerant tube 401 and the second refrigerant tube 402 may form a line to simplify the inner configuration. When the arrangement and welding process is implemented between the end of the first refrigerant tube 401 and the end of the second refrigerant tube 402, such the single line arrangement may be put into consideration.

Figure 6:
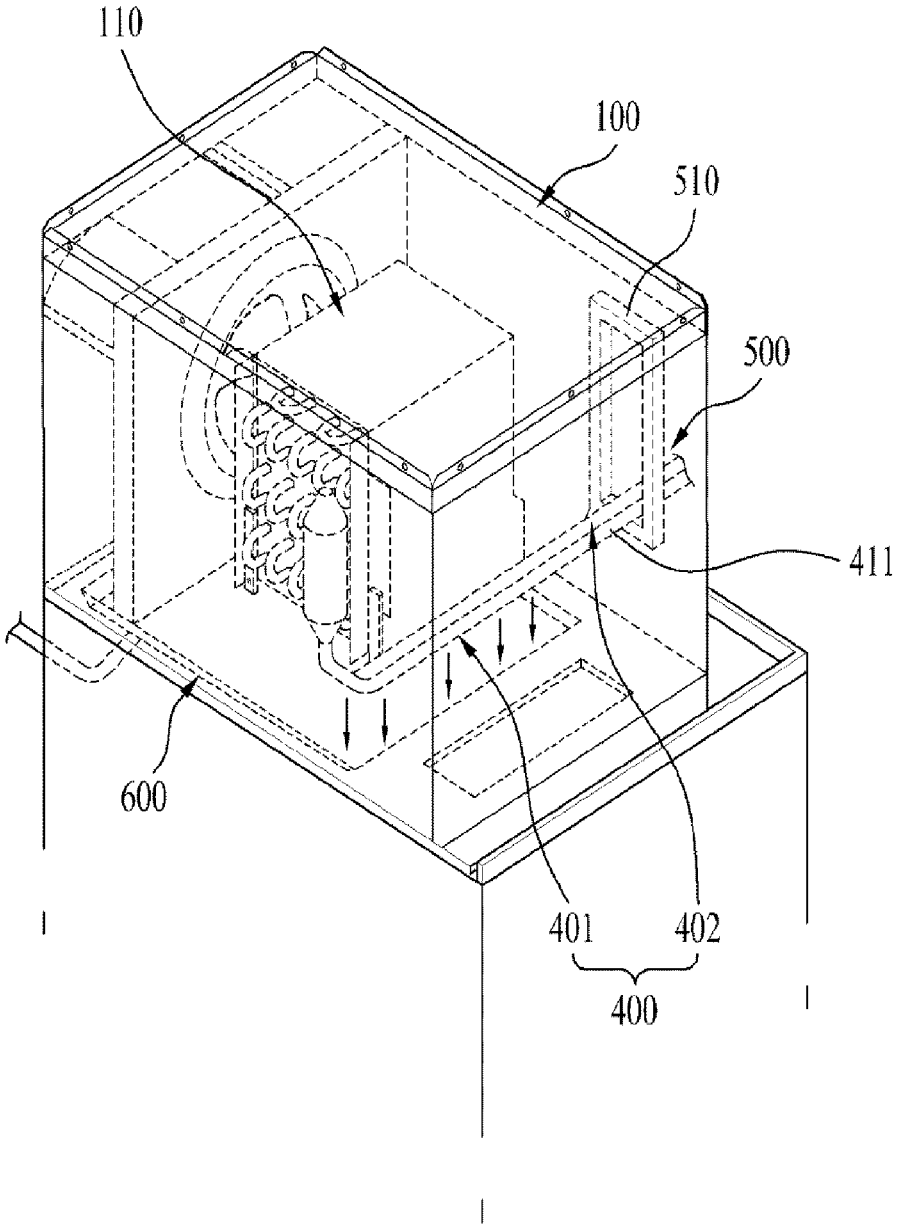
FIG. 6 is a perspective view illustrating inner configuration elements of a cold air generation chamber which are installed completely.

As shown in FIG. 6, the first refrigerant tube 401 and the second refrigerant tube 402 are connected by the welding and then the defrosted-water tray 600 is fixedly arranged below the evaporator 110 and the refrigerant tube 400, in the state of the evaporator 100 being fixed to the cold air generation chamber 100.

When the defrosting process is implemented to remove frost formed on the evaporator 110, the defrosted-water attached on the evaporator 110 and the refrigerant tube 400 may be collected in the defrosted-water tray 600 at one time.

If the refrigerant tube 400 inserted in the evaporator 100 is connected with the cold air generation chamber 100 via another space, not directly, difference between the temperature of the refrigerant passing the capillary tube 411 of the refrigerant tube 400 and the temperature of peripheral air makes an outlet end of the capillary tube 411 frozen severely. To prevent the freezing, an auxiliary heat-insulating member is required.

However, the refrigerant tube 400 according to the present disclosure is directly inserted in the cold air generation chamber 100, this auxiliary heat-insulating member configured to prevent the freezing problem is not required.

It will be apparent to those skilled in the art that various modifications and variations can be made in the present disclosure without departing from the spirit or scope of the inventions.

Thus, it is intended that the present disclosure covers the modifications and variations of this disclosure provided they come within the scope of the appended claims and their equivalents.

The invention claimed is:

1. A refrigerator comprising: a cabinet comprising a storage chamber;

a cold air generation chamber provided at a left portion above the storage chamber; an evaporator provided in the cold air generation chamber; a machine room provided on a right side of the cold air generation chamber; a compressor provided in the machine room; a condenser provided in the machine room;

a refrigerant tube configured to pass through a right side wall of the cold air generation chamber, arranged over a bottom surface of the cold air generation chamber, to be connected with the evaporator; and an installation part provided in the right side wall of the cold air generation chamber, the right side wall facing the machine room, and the installation part having a through hole elongated in an up and down direction and located forward of a front surface of the evaporator, the refrigerant tube including:

a first refrigerant tube connected with the evaporator; and a second refrigerant tube arranged to pass through the installation part in an upwardly bent state, the second refrigerant tube including a first portion and a second portion, the first portion being bendable between a first position and a second position with respect to the second portion, wherein the through hole is sized to accommodate the first portion in the upwardly bent state, wherein the second refrigerant tube is configured to be connected to the first refrigerant tube when the first portion is in the second position, and wherein the first portion of the second refrigerant tube passes through the through hole in the upwardly bent state when the first portion of the second refrigerant tube is in the first position, and wherein the first refrigerant tube and the second refrigerant tube comprise metal and are welded to be connected with each other when the first portion of the second refrigerant tube is in the second position.

2. The refrigerator as claimed in claim 1, wherein the refrigerant tube comprises:

a capillary tube configured to reduce and expand a pressure of refrigerant drawn into the evaporator; and a guide tube configured to guide the refrigerant exhausted from the evaporator toward a compressor provided outside the cold air generation chamber.

3. The refrigerator as claimed in claim 1, further comprising:

a rim part configured to surround the installation part, the rim part formed thicker than the installation part to reinforce rigidity of a rim of the installation part.

4. The refrigerator as claimed in claim 1, wherein the evaporator is located in a predetermined portion in rear of the installation part, and the first refrigerant tube is located in front of a front surface of the evaporator to be connected with the second refrigerant tube having passed the installation part provided in front of the evaporator, in a line.

5. The refrigerator as claimed in claim 4, further comprising:

a defrosted-water tray provided below the evaporator and the first and second refrigerant tubes to receive defrosted-water generated in the evaporator and the first and second refrigerant tubes therein.

6. A manufacturing method of a refrigerator comprising a cold air generation chamber provided above a storage chamber beside on a left side of a machine room, with an evaporator installed therein, the manufacturing method comprising:

(A) installing a first refrigerant tube through a right side wall of the cold air generation chamber, the right side wall facing the machine room, having a through hole elongated in an up and down direction and located forward of a front surface of the evaporator, the first refrigerant tube including a first portion and a second portion, the first portion being bendable between a first position and a second position with respect to the second portion, wherein, when the first portion is in the first position, a center axis of the first portion extends at a first angle with respect to a center axis of the second portion, and, when the first portion is in the second position, the center axis of the first portion extends at a second, different angle with respect to the center axis of the second portion;

(B) installing the evaporator comprising a second refrigerant tube corresponding to the first refrigerant tube in the cold air generation chamber; and (C) connecting the first refrigerant tube and the second refrigerant tube with each other, wherein connecting the first refrigerant tube and the second refrigerant tube comprises:

(C-1) adjusting locations of ends of the first and second refrigerant tubes to be identical to each other by moving the first portion from the first position to the second position, after the first portion of the second refrigerant tube passes through the through hole in an upwardly bent state; and (C-2) welding the ends of the first and second refrigerant tubes to be connected, after locating the ends of the first and second refrigerant tubes to be identical to each other.

7. The manufacturing method as claimed in claim 6, wherein the first refrigerant tube and the second refrigerant tube respectively comprise:

a capillary tube configured to reduce and expand a pressure of refrigerant drawn into the evaporator; and a guide tube configured to guide the refrigerant exhausted from the evaporator toward a compressor provided outside the cold air generation chamber.

8. A refrigerator comprising:

a cabinet comprising a storage chamber;

a cold air generation chamber provided at a left portion above the storage chamber;

an evaporator provided in the cold air generation chamber;

a machine room provided on a right side of the cold air generation chamber;

a compressor provided in the machine room;

a condenser provided in the machine room;

a refrigerant tube configured to pass through a right side wall of the cold air generation chamber, arranged over a bottom surface of the cold air generation chamber, to be connected with the evaporator; and an installation part provided in the right side wall of the cold air generation chamber, the installation part having a through hole elongated in an up and down direction and located forward of a front surface of the evaporator, the refrigerant tube including:

a first refrigerant tube connected with the evaporator; and a second refrigerant tube arranged to pass through the installation part in an upwardly bent state, the second refrigerant tube including a first portion and a second portion, the first portion being bendable between a first position and a second position with respect to the second portion, wherein, when the first portion is in the first position, a center axis of the first portion extends at a first angle with respect to a center axis of the second portion, and, when the first portion is in the second position, the center axis of the first portion extends at a second, different angle with respect to the center axis of the second portion, wherein the through hole is sized to accommodate the first portion in the upwardly bent state, wherein the first portion of the second refrigerant tube passes through the through hole in the upwardly bent state when the first portion of the second refrigerant tube is in the first position, and wherein the second refrigerant tube is configured to be connected to the first refrigerant tube when the first portion is in the second position.

9. The refrigerator as claimed in claim 8, further comprising:

a cold air inlet formed in a front portion of the bottom surface of the cold air generation chamber;

a cold air outlet in a rear portion of the bottom surface of the cold air generation chamber; and a guide duct connected with the cold air outlet and extended downwards to distribute cold air exhausted from the cold air outlet into the storage chamber.

10. The refrigerator as claimed in claim 9, further comprising:

a defrosted-water tray provided between the cold air inlet and the cold air outlet to receive defrosted-water generated on the evaporator and the first and second refrigerant tubes therein.

11. The refrigerator according to claim 1, wherein the first angle is substantially 90 degrees.

* * * * *